US009820050B2

(12) United States Patent
Wu et al.

(10) Patent No.: US 9,820,050 B2
(45) Date of Patent: Nov. 14, 2017

(54) BALANCED PUSH-PULL LOUDSPEAKER DEVICE, A CONTROL METHOD THEREOF, AND AN AUDIO PROCESSING CIRCUIT

(71) Applicant: AMTRAN TECHNOLOGY CO., LTD, New Taipei (TW)

(72) Inventors: Chia-Yu Wu, New Taipei (TW); Chih-Chung Yang, New Taipei (TW); Ya-Hsuan Lin, New Taipei (TW)

(73) Assignee: AMTRAN TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/415,792

(22) Filed: Jan. 25, 2017

(65) Prior Publication Data

US 2017/0265002 A1 Sep. 14, 2017

(30) Foreign Application Priority Data

Mar. 9, 2016 (TW) ..... 105107189 A

(51) Int. Cl.

| | |
|---|---|
| ***H04R 3/14*** | (2006.01) |
| ***H04R 1/24*** | (2006.01) |
| ***H04R 1/02*** | (2006.01) |

(52) U.S. Cl.

CPC ..... *H04R 3/14* (2013.01); *H04R 1/025* (2013.01); *H04R 1/24* (2013.01)

(58) Field of Classification Search

CPC .... H04R 19/02; H04R 19/013; H04R 31/003; H04R 5/02; H04R 9/06; H04R 1/403; H04R 2307/201

See application file for complete search history.

(56) References Cited

U.S. PATENT DOCUMENTS

| | | | | |
|---|---|---|---|---|
| 6,381,333 | B1 | 4/2002 | Suzuki | |
| 8,885,836 | B2 | 11/2014 | McGrath et al. | |
| 2017/0238088 | A1* | 8/2017 | Wen | H04R 1/2849 |

FOREIGN PATENT DOCUMENTS

CN 201813522 U * 4/2011

* cited by examiner

*Primary Examiner* — Mohammad Islam

(74) *Attorney, Agent, or Firm* — Maschoff Brennan

(57) ABSTRACT

A balanced push-pull loudspeaker device includes a loudspeaker box, a first loudspeaker component, a second loudspeaker component and an audio processing unit. The audio processing unit generates a bass audio signal according to low frequency parts of a first audio channel signal and of a second audio channel signal, mixes the bass audio signal and a high frequency part of the first audio channel signal, outputs a mixture of the bass audio signal and the high frequency part of the first audio channel signal to the first loudspeaker component, inverts the bass audio signal, mixes the inverted bass audio signal and a high frequency part of the second audio channel signal, and outputs a mixture of the inverted bass audio signal and the high frequency part of the second audio channel signal to the second loudspeaker component. This disclosure also provides a control method applied to the above loudspeaker device.

9 Claims, 8 Drawing Sheets

BALANCED PUSH-PULL LOUDSPEAKER DEVICE, A CONTROL METHOD THEREOF, AND AN AUDIO PROCESSING CIRCUIT

CROSS-REFERENCE TO RELATED APPLICATIONS

This non-provisional application claims priority under 35 U.S.C. §119(a) on Patent Application No(s). 105107189 filed in Taiwan, R.O.C. on Mar. 9, 2016, the entire contents of which are hereby incorporated by reference.

BACKGROUND

Technical Field

This disclosure relates to a balanced push-pull loudspeaker device and a control method thereof, an audio processing circuit and a processing method of audio signals, and more particularly to a loudspeaker device having at least two loudspeaker components, and a control method thereof.

Related Art

Because low frequency sound waves have longer wavelengths, the air volume to be pushed for generating such sound waves is greater than that for high frequency sound waves. When a loudspeaker component reproduces low frequency sounds, the vibration diaphragm of the loudspeaker component must have a larger area to push more air to generate resonance in order to present low frequency sound effects more smoothly. In a conventional loudspeaker device for reproducing low frequency sounds, a loudspeaker component is usually disposed on a loudspeaker box of a corresponding capacity along with the performance parameters of the loudspeaker component. As a result, the loudspeaker component can generate the sound effects at exact harmonic frequencies and the low frequency sound effects are enhanced.

However, in consideration of easy disposition and aesthetic purpose, the loudspeaker component and the capacity of the loudspeaker box in a currently available loudspeaker device have been designed to have smaller and smaller sizes, making the frequency response of the loudspeaker device fail to better work in low frequency region. As the loudspeaker reproduces the low frequency sounds, a sound distortion easily occurs.

SUMMARY

This disclosure provides a balanced push-pull loudspeaker device and a control method thereof, an audio processing circuit, and a processing method of audio signals to solve the problem that a conventional loudspeaker device has a poor frequency response in low frequency region.

According to one or more embodiments of this disclosure, a balanced push-pull loudspeaker device includes a loudspeaker box, a first loudspeaker component, a second loudspeaker component and an audio processing module. The loudspeaker box has a first opening and a second opening on the casing of the loudspeaker box. The first loudspeaker component includes a first vibration diaphragm which covers the first opening of the loudspeaker box and sinks into the inner space of the loudspeaker box relative to the first opening. The second loudspeaker component includes a second vibration diaphragm which covers the second opening of the loudspeaker box and sinks into the inner space of the loudspeaker box relative to the second opening. The audio processing module is configured to generate a bass audio signal according to a low frequency part of a first audio channel signal and a low frequency part of a second audio channel signal, mix the bass audio signal and a high frequency part of the first audio channel signal, and output a mixture of the bass audio signal and the high frequency part of the first audio channel signal to the first loudspeaker component. The audio processing module is also configured to invert the bass audio signal, mix the inverted bass audio signal and a high frequency part of the second audio channel signal, and output a mixture of the inverted bass audio signal and the high frequency part of the second audio channel signal to the second loudspeaker component. Besides, when the first loudspeaker component and the second loudspeaker component output sound effects, the first vibration diaphragm and the second vibration diaphragm respectively thrust in two opposite directions relative to the inner space of the loudspeaker box.

One or more embodiments of this disclosure provide a control method of a balanced push-pull loudspeaker device including a loudspeaker box, a first loudspeaker component and a second loudspeaker component. The first loudspeaker component includes a first vibration diaphragm, and the second loudspeaker component includes a second vibration diaphragm. The control method includes the following steps: generating a bass audio signal according to a low frequency part of a first audio channel signal and a low frequency part of a second audio channel signal, mixing the bass audio signal and a high frequency part of the first audio channel signal and providing a mixture of the bass audio signal and the high frequency part of the first audio channel signal to the first loudspeaker component, inverting the bass audio signal to generate an inverse bass audio signal, mixing the inverted bass audio signal and a high frequency part of the second audio channel signal and providing a mixture of the inverted bass audio signal and the high frequency part of the second audio channel signal to the second loudspeaker component, and the first vibration diaphragm and the second vibration diaphragm thrusting in two opposite directions relative to the inner space of the loudspeaker box when the first loudspeaker component and the second loudspeaker component output sound effects.

According to one or more embodiments of this disclosure, an audio processing circuit is capable of converting a number of original audio channel signals into a number of terminal audio channel signals and includes a low pass filtering unit, a high pass filtering unit, an inverting unit and a mixing unit. The low pass filtering unit is configured to filter a low frequency part out of the original audio signals. The high pass filtering unit is configured to filter a number of high frequency parts out of the original audio signals. The inverting unit is configured to invert the low frequency part to output an inverse low frequency part. The mixing unit is configured to mix the low frequency part with one of the high frequency parts, output a mixture of the low frequency part and the high frequency part as one of the terminal audio channel signals, mix the inverse low frequency part with another one of the high frequency parts, and output a mixture of the inverse low frequency part and the high frequency part as another one of the terminal audio channel signals.

According to one or more embodiments of this disclosure, a processing method of audio signals is applied to convert signals of original audio channels into signals of terminal audio channels. The processing method includes the following steps: filtering a low frequency part out of the signals of the original audio channels, filtering a plurality of high frequency parts out of the signals of the original audio channels, inverting the low frequency part to output an inverse low frequency part, mixing the low frequency part with one of the high frequency parts, outputting a mixture of the low frequency part and the high frequency part as one of the signals of the terminal audio channels, mixing the inverse low frequency part with another one of the high frequency parts, and outputting a mixture of the inverse low frequency part and the high frequency part as another one of the signals of the terminal audio channels.

In view of the above, one or more embodiments of this disclosure provide a balanced push-pull loudspeaker device and a control method thereof, an audio processing circuit and a processing method of audio signals. The low frequency part of the first audio channel signal and the low frequency part of the second audio channel signal are mixed to generate a bass audio signal, the high frequency part of the first audio channel signal is mixed with the bass audio signal to generate a mixed signal, the high frequency part of the second audio channel signal is mixed with the inverted bass audio signal to generate another mixed signal, and then the mixed signals are respectively provided to the first loudspeaker component and the second loudspeaker component. In this way, when the first loudspeaker component and the second loudspeaker component output the sound effects, the vibration diaphragms of the first loudspeaker component and the second loudspeaker component respectively thrust in opposite directions relative to the inner space of the loudspeaker box so that the capacity of the inner space of the loudspeaker box is balanced. Therefore, the possibility that the noises and the harmonic distortion are caused as the first vibration diaphragm and the second vibration diaphragm simultaneously thrust in the same direction is reduced.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
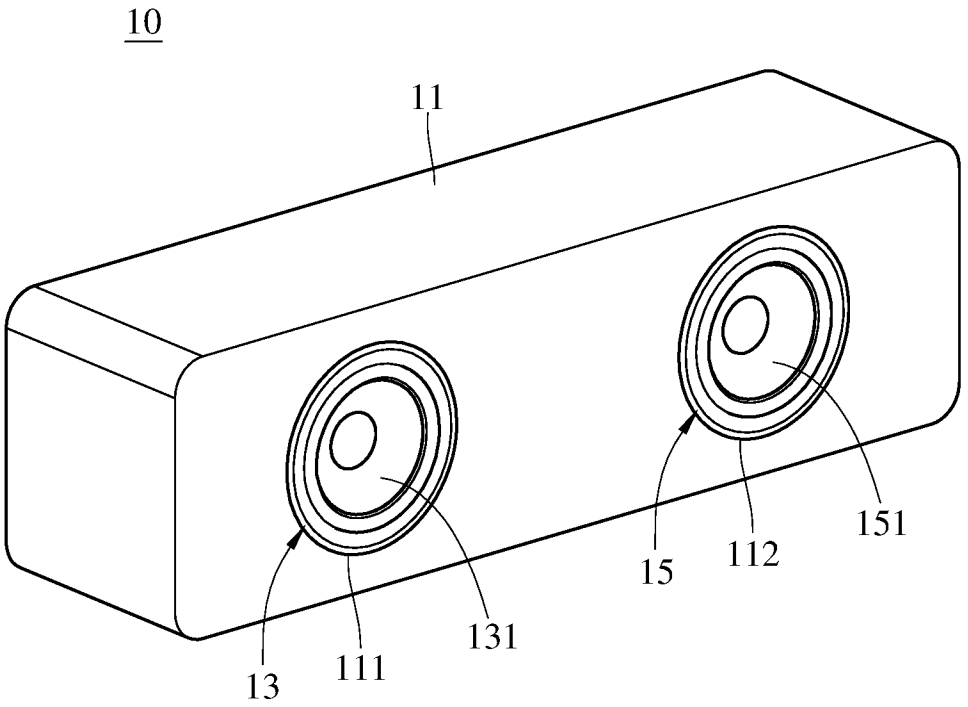
FIG. 1 is a stereogram of a loudspeaker device according to an embodiment of this disclosure.
Figure 2:
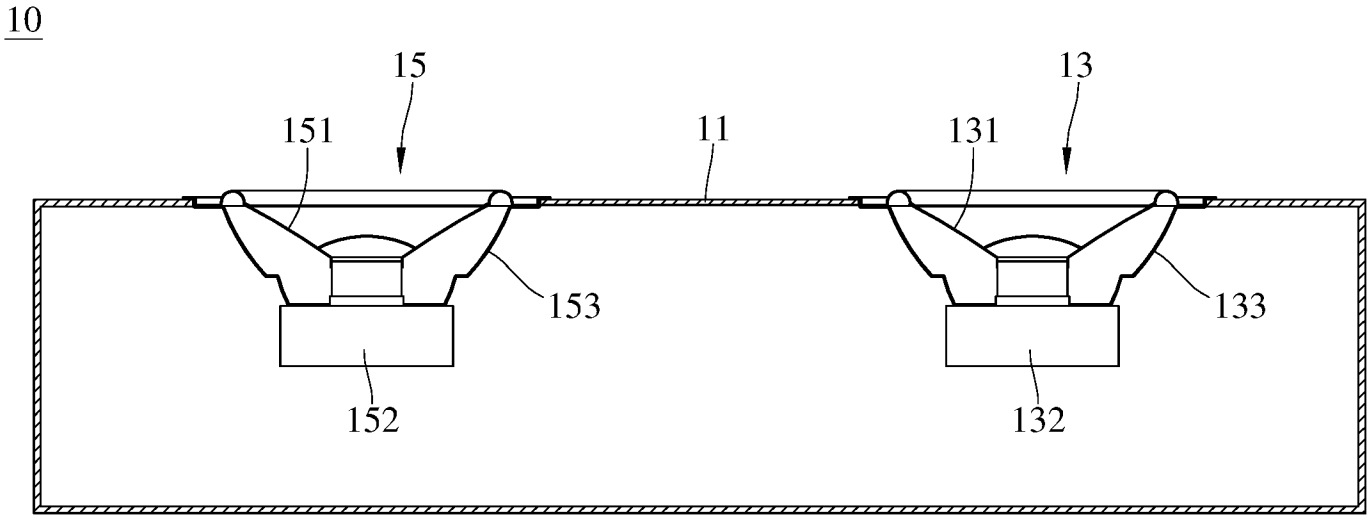
FIG. 2 is a top view of a loudspeaker device according to an embodiment of this disclosure.
Figure 3:
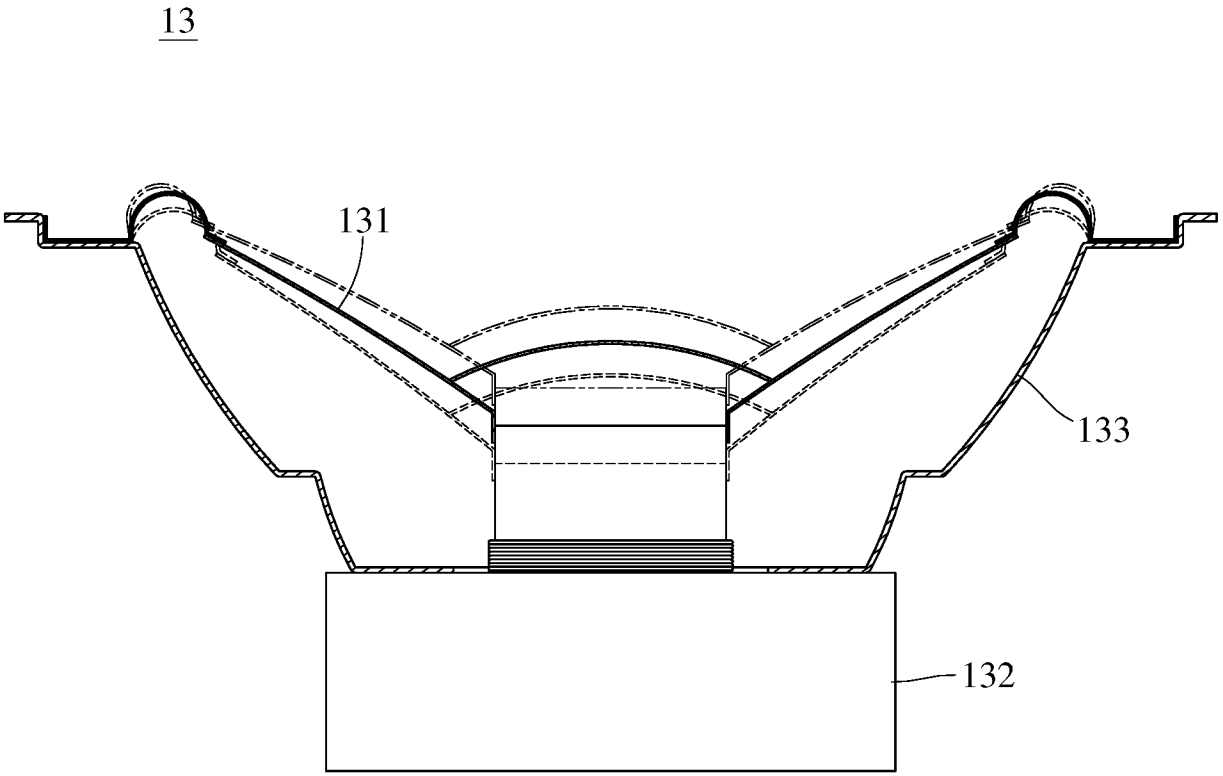
FIG. 3 is a schematic diagram of the thrust done by a first vibration diaphragm of a first loudspeaker component according to an embodiment of this disclosure.

Please refer FIG. 1 to FIG. 3. FIG. 1 is a stereogram of a loudspeaker device according to an embodiment of this disclosure. FIG. 2 is a top view of a loudspeaker device according to an embodiment of this disclosure. FIG. 3 is a schematic diagram of the thrust done by a first vibration diaphragm of a first loudspeaker component according to an embodiment of this disclosure. As shown in the figures, a loudspeaker device 10, such as a complete speaker system, includes a loudspeaker box 11, a first loudspeaker component ("FLC") 13, a second loudspeaker component ("SLC") 15 and an audio processing module ("APM") 17 (shown in FIG. 4). The loudspeaker device 10 receives an audio signal from, for example, an amplifier or other suitable audio source device, so as to drive the FLC 13 and the SLC 15 to output sounds.

The loudspeaker box 11 has a first opening 111 and a second opening 112 on its casing. For example, the loudspeaker box 11 is made of plastic, planks, medium density fiberboards or other suitable material. This disclosure does not intend to limit the shape, thickness of the casing and internal capacity of the loudspeaker box 11. Besides, a sound absorbing material or other element capable of attenuating air vibration inside casing can be disposed in the loudspeaker box 11. In this embodiment, the casing of the loudspeaker box 11 may form the shell of the loudspeaker device 10. In another embodiment, the loudspeaker box 11 may be a box inside the casing of the loudspeaker device 10, and a shock absorbing material may be disposed between the loudspeaker box 11 and the casing.

The FLC 13 includes a first vibration diaphragm 131, an actuator 132 and a vibration diaphragm frame 133. In another embodiment, the FLC 13 may also include a center cap, a surrounding or other suitable element, which is not limited in this disclosure. The first vibration diaphragm 131 of the FLC 13 covers the first opening 111 of the loudspeaker box 11 and sinks into the inner space of the loudspeaker box 11 relative to the first opening 111. In other words, the FLC 13 outputs sounds to the outside of the loudspeaker box 11.

Similarly, the SLC 15 includes a second vibration diaphragm 151, an actuator 152 and a vibration diaphragm frame 153. The second vibration diaphragm 15 covers the second opening 112 of the loudspeaker box 11 and sinks into the inner space of the loudspeaker box 11 relative to the second opening 112. The FLC 13 and the SLC 15 are active loudspeakers. The FLC 13 and the SLC 15 generate magnetic field change in response to received currents or voltages to drive the first vibration diaphragm 131 and the second vibration diaphragm 151 which then inwardly or outwardly thrust relative to the inner space of the loudspeaker box 11 so that the air vibrates to output sounds. The size of the FLC 13 is not limited to be the same as that of the SLC 15. When the first vibration diaphragm 131 and the second vibration diaphragm 151 respectively cover the first opening 111 and the second opening 112 of the loudspeaker box 11, an enclosed space may be formed among the loudspeaker box 11, the first vibration diaphragm 131 and the second vibration diaphragm 151.

In this embodiment, the thrust of the first vibration diaphragm 131 relative to the inner space of the loudspeaker box 11 refers to that most of the area of the first vibration diaphragm 131 pushes inwardly into the loudspeaker box 11. In practice, the first vibration diaphragm 131 is distorted when it vibrates, so when the first vibration diaphragm 131 pushes inwardly into the loudspeaker box 11, a small part of the first vibration diaphragm 131 thrusts outwardly, and vice versa, as shown in FIG. 3. Identically, the vibration of the second vibration diaphragm 151 is a similar one, so we shall not repeat the detail description here.

The APM 17 generates a bass audio signal according to the low frequency part of a first audio channel signal ("FACS") and the low frequency part of a second audio channel signal ("SACS"), mixes the bass audio signal and the high frequency part of the FACS, and outputs a mixture of the bass audio signal and the high frequency part of the FACS to the FLC 13. The FLC 13 outputs sound effects according to the mixture of the bass audio signal and the high frequency part of the FACS. The APM 17 inverts the bass audio signal, mixes the inverted bass audio signal and the high frequency part of the SACS, and outputs a mixture of the inverted bass audio signal and the high frequency part of the SACS to the SLC 15. The SLC 15 outputs sound effects according to the mixture of the inverted bass audio signal and the high frequency part of the FACS. When the FLC 13 and the SLC 15 output sound effects, the first vibration diaphragm 131 and the second vibration diaphragm 151 respectively thrust in two opposite directions relative to the inner space of the loudspeaker box. In other words, when the first vibration diaphragm 131 inwardly thrusts relative to the inner space of the loudspeaker box 11, the second vibration diaphragm 151 outwardly thrusts relative to the inner space of the loudspeaker box 11; and vise versa.

To conveniently depict that the present embodiment uses the inverted bass audio signal to make the first vibration diaphragm 131 and the second vibration diaphragm 151 respectively thrust in two opposite directions, the following description temporarily omits the high frequency part of the FACS and the high frequency part of the SACS. After the APM 17 mixes the low frequency part of the FACS and the low frequency part of the SACS to generate the bass audio signal, the FLC 13 will receive the bass audio signal, and the SLC 15 will receive the inverted bass audio signal which is 180 degree out of phase with the bass audio signal. When the bass audio signal received by the FLC 13 is in the positive half of a cycle, the first vibration diaphragm 131 of the FLC 13 thrusts outwardly relative to the inner space of the loudspeaker box 11. At the meantime, the inverted bass audio signal received by the SLC 15 is in the negative half of the cycle, the second vibration diaphragm 151 of the SLC 15 thrusts inwardly relative to the inner space of the loudspeaker box 11, and vice versa.

Therefore, the FLC 13 receives the bass audio signal, and the SLC 15 receives the inverted bass audio signal, so that the first vibration diaphragm 131 of the FLC 13 and the second vibration diaphragm 151 of the SLC 15 respectively thrust in opposite directions. The first vibration diaphragm 131 and the second vibration diaphragm 151, thrusting in opposite directions, balance the internal capacity of the loudspeaker box 11. As a result, when the FLC 13 and the SLC 15 output sound effects, the barometric pressure inside the loudspeaker box 11 is approximately equal to the barometric pressure outside the loudspeaker box 11. As the capacity of the loudspeaker box 11 is smaller, by having the diaphragms 131 and 151 thrusting in opposite directions, noise and harmonic distortion, caused by huge barometric pressure change inside the loudspeaker box 11 once the diaphragms 131 and 151 simultaneously thrust inwardly or outwardly, may be avoided.

Figure 4:
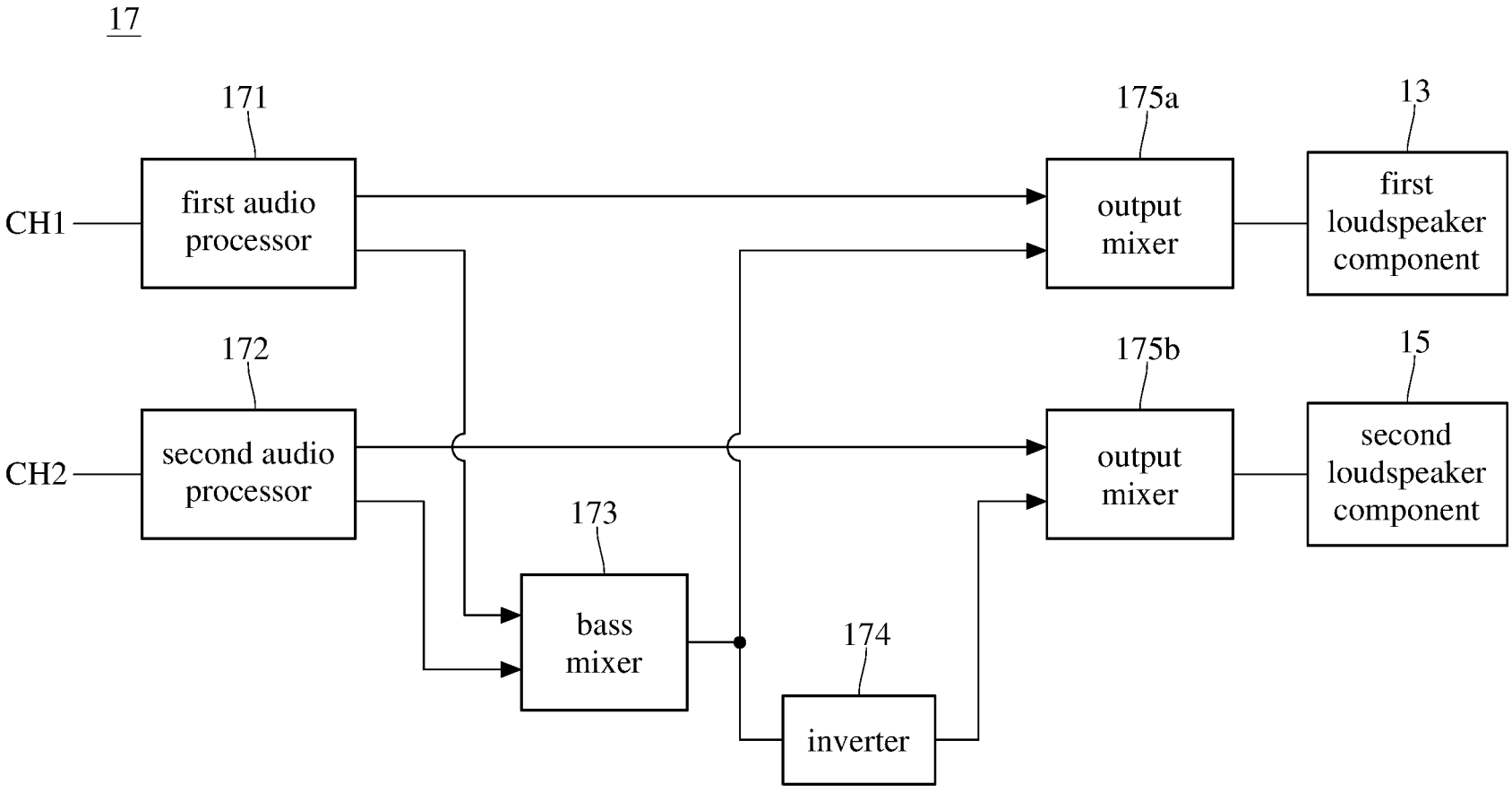
FIG. 4 is a functional block diagram of an audio processing module in an embodiment of this disclosure.

Please refer to FIG. 1 and FIG. 4. FIG. 4 is a functional block diagram of an APM in an embodiment of this disclosure. As shown in the figures, the APM 17 includes a first audio processor 171, a second audio processor 172, a bass mixer 173, an inverter 174, and output mixers 175*a*, 175*b*. In this embodiment, the APM 17 receives the FACS from a receiving end CH1 and the SACS from a receiving end CH2.

For example, the first audio processor 171 and the second audio processor 172 are audio filters configured to filter the audio signal into the high frequency part and the low frequency part. More specifically, the first audio processor 171 includes a low pass filter and a high pass filter, for example. The first audio processor 171 outputs the FASC's high frequency part whose frequency is higher than a first cutoff frequency as well as the FASC's low frequency part whose frequency is lower than the first cutoff frequency after receiving and filtering the FACS. The first audio processor 171, for example, attenuates or blocks the FASC's low frequency part whose frequency is lower than the first cutoff frequency, in order to output the FASC's high frequency part. The first audio processor 171 attenuates or blocks the FASC's high frequency part whose frequency is higher than a first cutoff frequency, in order to output the FASC's low frequency part. The first cutoff frequency depends on, for example, the size, Thiele-Small parameters or other factor of the FLC 13, which is not limited in this disclosure. Also, the first cutoff frequency can be set by the designer directly according to practical requirements.

Similarly, the second audio processor 172 includes, for example, a low pass filter and a high pass filter. The second audio processor 172 outputs the SACS's high frequency part whose frequency is higher than a second cutoff frequency as well as the SACS's low frequency part whose frequency is lower than the second cutoff frequency after receiving and filtering the SACS. The second cutoff frequency depends on, for example, the size, Thiele-Small parameters or other factor of the SLC 15. The first cutoff frequency can also be set by the designer directly according to practical requirements, and this disclosure does not intend to limit the way the first cutoff frequency is decided. The bass mixer 173 is coupled to the first audio processor 171 and the second audio processor 172 to receive the low frequency part of the FACS and the low frequency part of the SACS. The bass mixer 173 also mixes the low frequency part of the FACS and the low frequency part of the SACS to generate the bass audio signal.

The output mixer 175*a* receives the high frequency part of the FACS and the bass audio signal output by the bass mixer 173, mixes the high frequency part of the FACS and the bass audio signal to generate a first mixed audio signal, and outputs the first mixed audio signal to the FLC 13. On the other hand, the bass mixer 173 outputs the bass audio signal to the inverter 174. The inverter 174 outputs the inverted bass audio signal to the output mixer 175*b* after shifting the phase of the bass audio signal by 180 degrees. The output mixer 175*b* receives the high frequency part of the SACS and the inverted bass audio signal, mixes the high frequency part of the SACS and the inverted bass audio signal to generate a second mixed audio signal, and outputs the second mixed audio signal to the SLC 15. Accordingly, when the FLC 13 and the SLC 15 output sound effects according to the received mixed audio signals, the first vibration diaphragm 131 of the FLC 13 and the second vibration diaphragm 151 of the SLC 15 respectively thrust in opposite directions relative to the inner space of the loudspeaker box 11.

Figure 5:
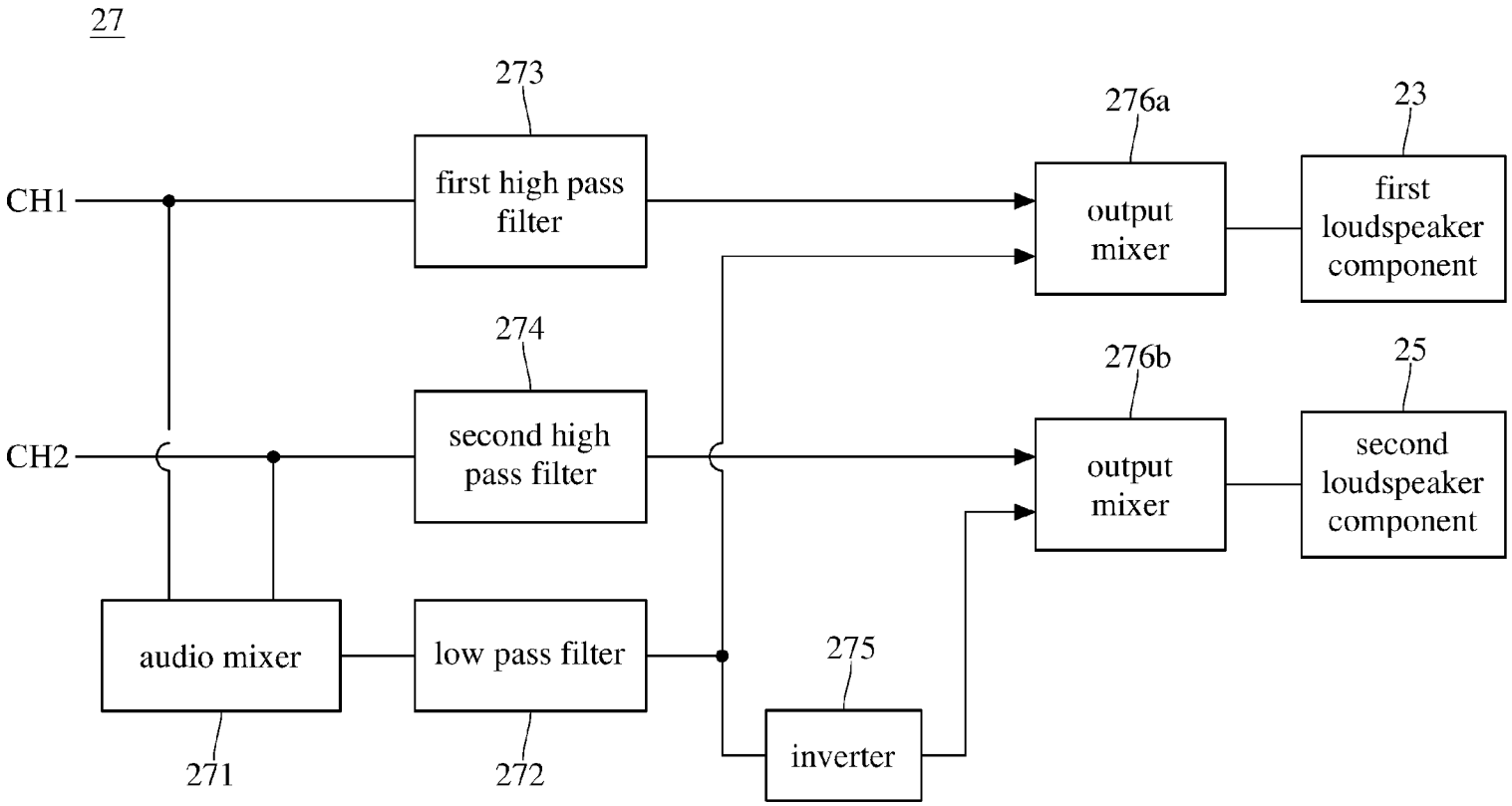
FIG. 5 is a functional block diagram of an audio processing module in another embodiment of this disclosure.

Please refer to FIG. 5. FIG. 5 is a functional block diagram of an APM in another embodiment of this disclosure. As shown in FIG. 5, the APM 27 includes an audio mixer 271, a low pass filter 272, a first high pass filter 273, a second high pass filter 274, an inverter 275, output mixers 276*a*, 276*b*. Similar to the former embodiment, the APM 27 receives the FACS from the receiving end CH1 and receives the SACS from the receiving end CH2.

The differences between this embodiment and the former embodiment is that the audio mixer 271 receives and mixes the FACS and the SACS and then outputs the mixture of the FACS and the SACS to the low pass filter 272. The low pass filter 272 filters the mixture of the FACS and the SACS through low pass filtering and outputs the bass audio signal. For example, the low pass filter 272 attenuates or blocks the high frequency part of the mixture of the FACS and the SACS to output the low frequency part of the mixture as the bass audio signal. The first high pass filter 273 filters the FACS through high pass filtering and outputs the high frequency part of the FACS. The second high pass filter 274 filters the SACS through high pass filtering and outputs the high frequency part of the SACS.

The cutoff frequencies of the low pass filter 272, the first high pass filter 273 and the second high pass filter 274 depend on, for example, the sizes, Thiele-Small parameters or other factors of the FLC 23 and the SLC 25. The cutoff frequencies can also be set by the designer according to practical needs, and this disclosure shall not limit the implementation manner.

The output mixer 276*a* receives the high frequency part of the FACS and the bass audio signal output by the low pass filter 272, mixes the high frequency part of the FACS and the bass audio signal to generate a first mixed audio signal, and outputs the first mixed audio signal to the FLC 23. On the other hand, the low pass filter 272 outputs the bass audio signal to the inverter 275. After reversing the phase of the bass audio signal by 180 degrees, the inverter 275 outputs the inverted bass audio signal to the output mixer 276*b*. The output mixer 276*b* receives the high frequency part of the SACS and the inverted bass audio signal, mixes the high frequency part of the SACS and the inverted bass audio signal to generate a second mixed audio signal, and outputs the second mixed audio signal to the SLC 25. Therefore, when the FLC 23 and the SLC 25 output sound effects according to the received mixed audio signals, the first vibration diaphragm of the FLC 23 and the second vibration diaphragm of the SLC 25 respectively thrust in opposite directions relative to the inner space of the loudspeaker box 21.

Figure 6:
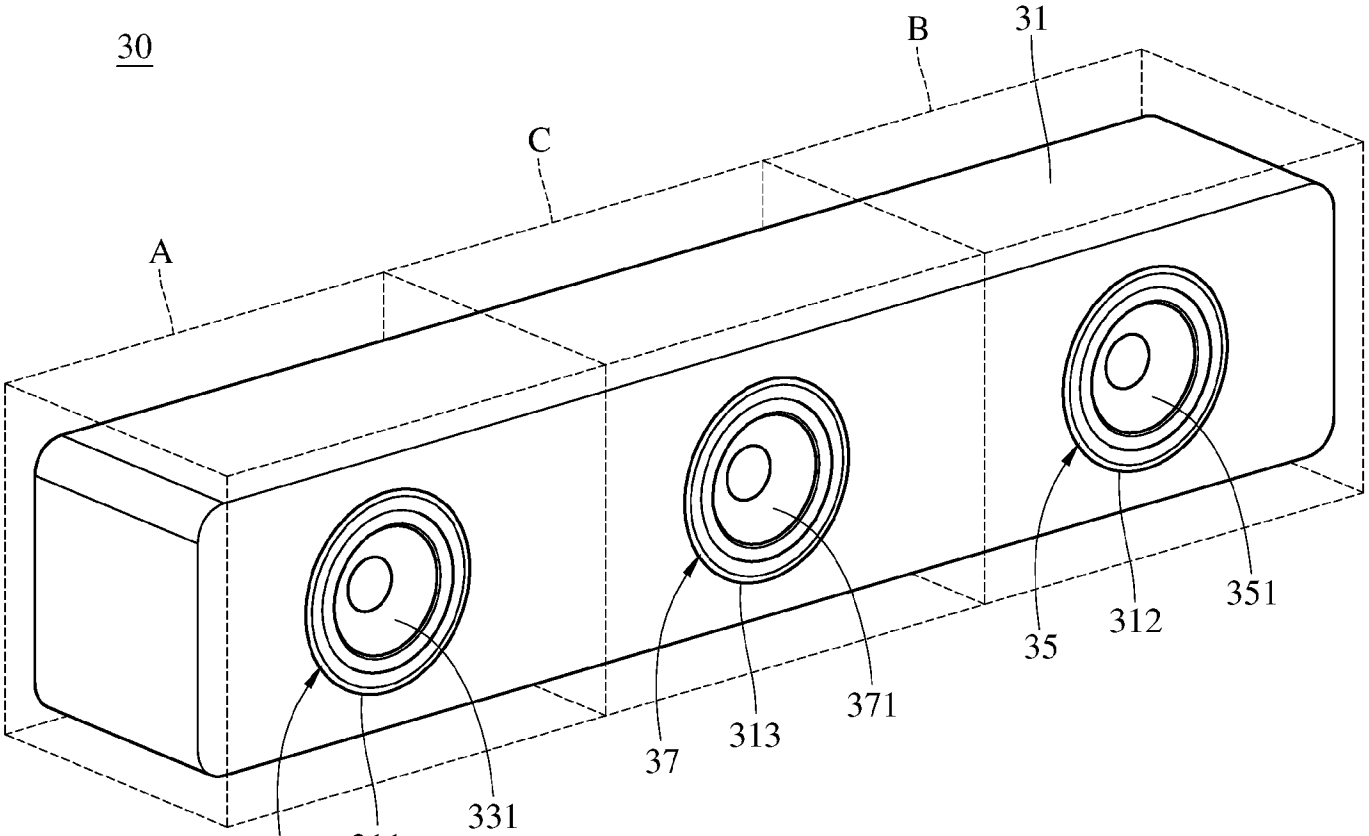
FIG. 6 is a stereogram of a loudspeaker device according to yet another embodiment of this disclosure.
Figure 7:
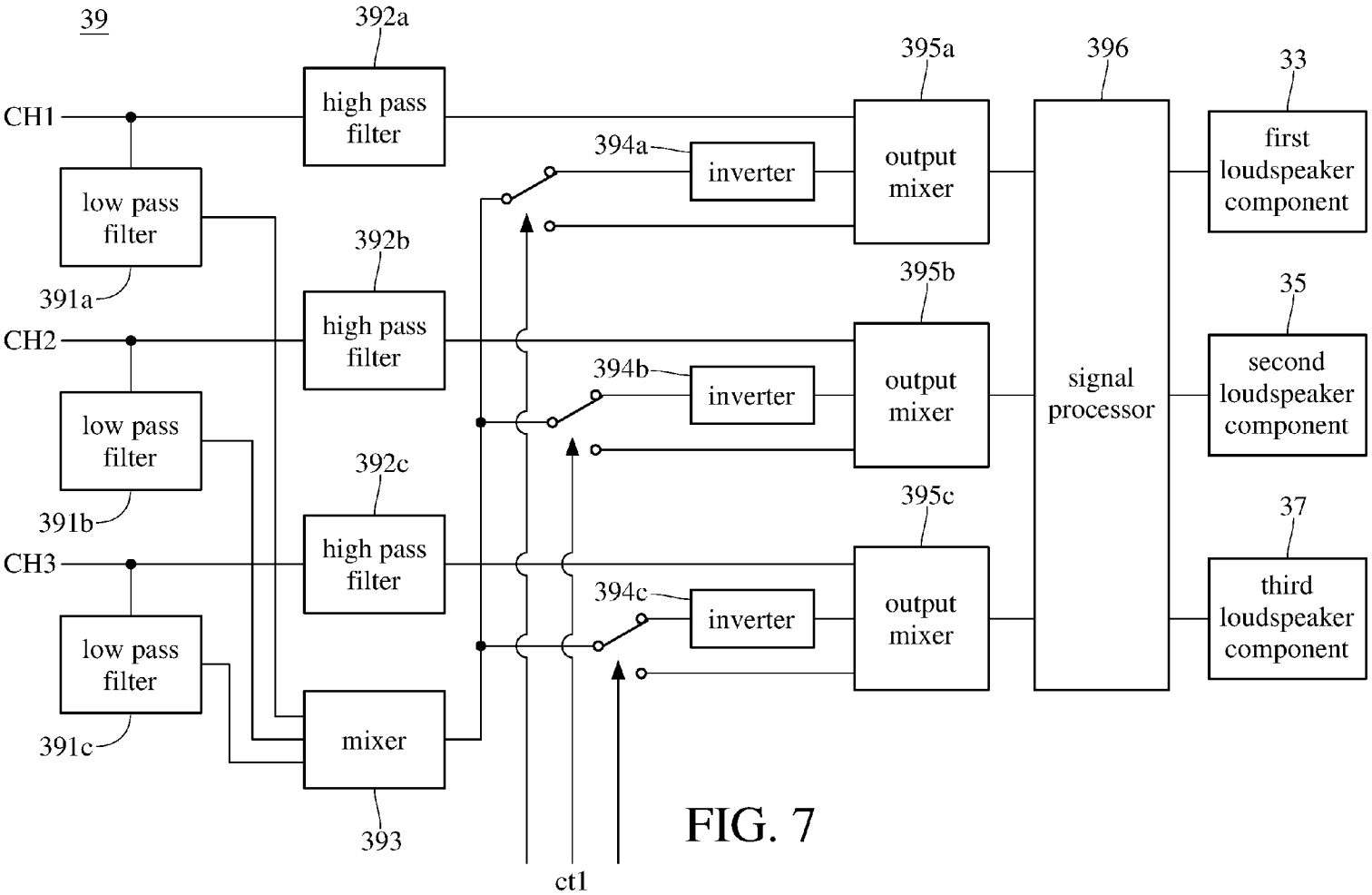
FIG. 7 is a functional block diagram of an audio processing module in yet another embodiment of this disclosure.

Please refer to FIG. 6 and FIG. 7. FIG. 6 is a stereogram of a loudspeaker device according to yet another embodiment of this disclosure. FIG. 7 is a functional block diagram of an APM in yet another embodiment of this disclosure. As shown in the figures, the loudspeaker device 30 includes a loudspeaker box 31, a FLC 33, a SLC 35, a third loudspeaker component ("TLC") 37 and an APM 39. The loudspeaker box 31 has a first opening 311, a second opening 312 and a third opening 313 on the casing. The FLC 33 includes at least a first vibration diaphragm 331 which covers the first opening 311 of the loudspeaker box 31 and sinks into the inner space of the loudspeaker box 31 relative to the first opening 311. The SLC 35 includes at least a second vibration diaphragm 351 which covers the second opening 312 of the loudspeaker box 31 and sinks into the inner space of the loudspeaker box 31 relative to the second opening 312. The TLC 37 includes at least a third vibration diaphragm 371 which covers the third opening 313 of the loudspeaker box 31 and sinks into the inner space of the loudspeaker box 31 relative to the third opening 313.

In this embodiment, the FLC 33, the SLC 35 and the TLC 37, acting as terminal audio channels, are active loudspeakers. That is, according to received currents or voltages, the FLC 33, the SLC 35 and the TLC 37 can actively drive the first vibration diaphragm 331, the second vibration diaphragm 351 and the third vibration diaphragm 371 to inwardly or outwardly thrust relative to the inner space of the loudspeaker box 31, which in turn makes air oscillate to output sounds. In this embodiment, the number of loudspeaker components is, for example, but not limited to three. Moreover, this disclosure does not intend to limit the sizes of the FLC 33, the SLC 35 and the TLC 37. When the first vibration diaphragm 331, the second vibration diaphragm 351 and the third vibration diaphragm 371 respectively cover the first opening 311, the second opening 312 and the third opening 313 of the loudspeaker box 31, an enclosed space may be formed among the loudspeaker box 31 and the vibration diaphragms 331, 351, 371.

As shown in FIG. 7, the APM 39 includes low pass filters 391*a*~391*c*, high pass filters 392*a*~392*c*, a mixer 393, inverters 394*a*~394*c*, output mixers 395*a*~395*c* and a signal processor 396. The APM 39 receives the FACS, the SACS and the third audio channel signal ("TACS") from the receiving ends CH1, CH2, CH3 (original audio channels), respectively.

The low pass filters 391*a*~391*c* respectively receive and apply low pass filtering to the FACS, the SACS and the TACS. Then, the low pass filters 391*a*~391*c* respectively output the FACS's low frequency part at a frequency lower than the first cutoff frequency, the SACS's low frequency part at a frequency lower than the second cutoff frequency and the TACS's low frequency part at a frequency lower than the third cutoff frequency. The high pass filters 392*a*~392*c* respectively receive and apply low pass filtering to the FACS, the SACS and the TACS. Then, the high pass filters 392*a*~392*c* respectively output the FACS's high frequency part at a frequency higher than the first cutoff frequency, the SACS's high frequency part at a frequency higher than the second cutoff frequency, and the TACS's high frequency part at a frequency higher than the third cutoff frequency.

For example, the first cutoff frequency, the second cutoff frequency and the third cutoff frequency respectively depend on the sizes, Thiele-Small parameters or other factors of the FLC 33, the SLC 35 and the TLC 37, but this disclosure does not intend to limit them. Also, the first cutoff frequency, the second cutoff frequency and the third cutoff frequency can be set by the designer according to practical requirements.

The mixer 393 is coupled to the low pass filter 391*a*~391*c* to receive the low frequency parts of the FACS, the SACS and the TACS. The mixer 393 mixes the low frequency parts of the FACS, the SACS and the TACS to generate the bass audio signal. In an embodiment, besides mixing the low frequency parts of the FACS, the SACS and the TACS to generate the bass audio signal, the mixer 393 can further adjust the bass audio signal. For example, the mixer 393 can reduce the sound intensity level of the bass audio signal.

The inverters 394*a*~394*c* are respectively coupled to the output mixers 395*a*~395*c*. The output mixer 395*a* is coupled to the FLC 33 via the signal processor 396. The output mixer 395*b* is coupled to the SLC 35 via signal processor 396. The output mixer 395*c* is coupled to the TLC 37 via signal processor 396. The signal processor 396 is configured to amplify the mixed audio signals output by the output mixers 395*a*~395*c* and output the amplified mixing audio signals to the FLC 33, the SLC 35 and the TLC 37, respectively. In another embodiment, the signal processor 396 is omitted, and the output mixers 395*a*~395*c* are directly coupled to the FLC 33, the SLC 35 and the TLC 37, respectively.

The output mixer 395*a* is coupled to the high pass filter 392*a* to receive the high frequency part of the FACS and selectively accept the inverted bass audio signal from the inverter 394*a* according to a control information ct1. In other words, the output mixer 395*a* decides to or not to receive the bass audio signal from the inverter 394*a* according to the control information ct1. When the output mixer 395*a* receives the bass audio signal from the inverter 394*a*, it means the output mixer 395*a* receives the inverted bass audio signal. The output mixer 395*a* mixes the inverted bass audio signal and the FACS's high frequency part, which is output by the high pass filter 392*a*, to generate a first mixed audio signal, and outputs the first mixed audio signal to the FLC 33. When the output mixer 395*a* does not receive the bass audio signal from the inverter 394*a*, it means that the output mixer 395*a* directly receives the bass audio signal from the mixer 393. The output mixer 395*a* mixes the non-inverted bass audio signal and the FACS's high frequency part, which is output by the high pass filter 392*a*, to generate a first audio signal and outputs the first audio signal to the FLC 33.

Similarly, the output mixer 395*b* is coupled to the high pass filter 392*b* to receive the high frequency part of the SACS, and selectively receives the bass audio signal from the inverter 394*b* according to the control information ct1. The output mixer 395*b* mixes either the bass audio signal or the inverted bass audio signal with the high frequency part of the SACS, which is output by the high pass filter 392*b*, to generate a second mixed audio signal, and outputs the second mixed audio signal to the SLC 35. The output mixer 395*c* is coupled to the high pass filter 392*c* to receive the high frequency part of the TACS, and selectively receive or block the bass audio signal from the inverter 394*c*, according to the control information ct1. The output mixer 395*c* mixes either the bass audio signal or the inverted bass audio signal with the high frequency part of the TACS, which is output by the high pass filter 392*c*, to generate a third mixed audio signal, and outputs the third mixed audio signal to the TLC 37.

Therefore, when the FLC 33, the SLC 35 and the TLC 37 output sound effects according to the received mixed audio signals, at least two of the first vibration diaphragm 331 of the FLC 33, the second vibration diaphragm 351 of the SLC 35 and the third vibration diaphragm 371 of the TLC 37 thrust in opposite directions relative to the inner space of the loudspeaker box 31. For example, when the control information ct1 indicates that the FLC 33 receives the inverted bass audio signal through the inverter 394*a*, the SLC 35 receives the inverted bass audio signal through the inverter 394*b*, and the TLC 37 does not receive the inverted bass audio signal through the inverter 394*b*, so long as the bass audio signal is in the positive half of a cycle, the first vibration diaphragm 331 and the second vibration diaphragm 351 inwardly thrust relative to the inner space of the loudspeaker box 31, and the third vibration diaphragm 371 outwardly thrusts relative to the inner space of the loudspeaker box 31. In contrast, as the bass audio signal is in the negative half of the cycle, the first vibration diaphragm 331 and the second vibration diaphragm 351 outwardly thrust relative to the inner space of the loudspeaker box 31, and the third vibration diaphragm 371 inwardly thrusts relative to the inner space of the loudspeaker box 31.

In an embodiment, the control information ct1, for example, is provided by another controller controlling the APM 39, or is generated by another control unit of the APM 39, but is not limited in this disclosure. The control information ct1 is related to the internal capacity, the shape of the inner space of the loudspeaker box 31, the number, the sizes and Thiele-Small parameters of the loudspeaker components. In practice, the inner space of the loudspeaker box 31 is not uniform. In other words, because of the shape of the loudspeaker device 30, the position of the APM 39 in the loudspeaker device 30, the volume of the sound absorbing material, or other possible factor, the airflow amounts pushed or pulled by thrust of the vibration diaphragms of the FLC 33, the SLC 35 and the TLC 37 are different. For example, when the APM 39 is disposed near the FLC 33, in the inner space of the loudspeaker box 31, the capacity of the region A neighboring to the FLC 33 is smaller than the capacity of the region B neighboring to the SLC 35 as well as the capacity of the region C neighboring to the TLC 37, as shown in FIG. 6. As a result, the airflow amount pushed by the FLC 33 is different from both the airflow amounts pushed by the SLC 35 and TLC 37.

In this example, because the capacity of the region A is smaller than both the region B and the region C, the control information ct1 indicates that the FLC 33 and the neighboring TLC 37 equally receive the inverted or non-inverted bass audio signal. When the FLC 33 and TLC 37 output sound effects, the first vibration diaphragm 331 and the third vibration diaphragm 371 thrust in the same direction relative to the inner space of the loudspeaker box 31. However, when the SLC 35 outputs sound effects, the second vibration diaphragm 351 thrusts in the direction opposite to the first vibration diaphragm 331 and the third vibration diaphragm 371. A person having ordinary skill in the art may design the control information ct1 in terms of actual requirements to control thrusting directions of the first vibration diaphragm 331, the second vibration diaphragm 351 and the third vibration diaphragm 371, and this embodiment is not limited to above implementation.

In other words, the loudspeaker device 30 controls the thrusting directions of the first vibration diaphragm 331, the second vibration diaphragm 351 and the third vibration diaphragm 371 by the control information ct1 so that the first vibration diaphragm 331, the second vibration diaphragm 351 and the third vibration diaphragm 371 can approximately balance the capacity of the inner space of the loudspeaker box 31. Therefore, when the FLC 33, the SLC 35 and the TLC 37 output sound effects, the possibility that the noises and the harmonic distortion are caused by a great change of air pressure inside the loudspeaker box 11 as all vibration diaphragms simultaneously thrust in the same direction is reduced.

In this embodiment, the FACS, the SACS and the TACS may be mixed before being filtered by the low pass filter. A person having ordinary skill in the art can understand the methods of implementation by referring to the embodiment in FIG. 5, so the related details shall not be repeated here.

Figure 8:
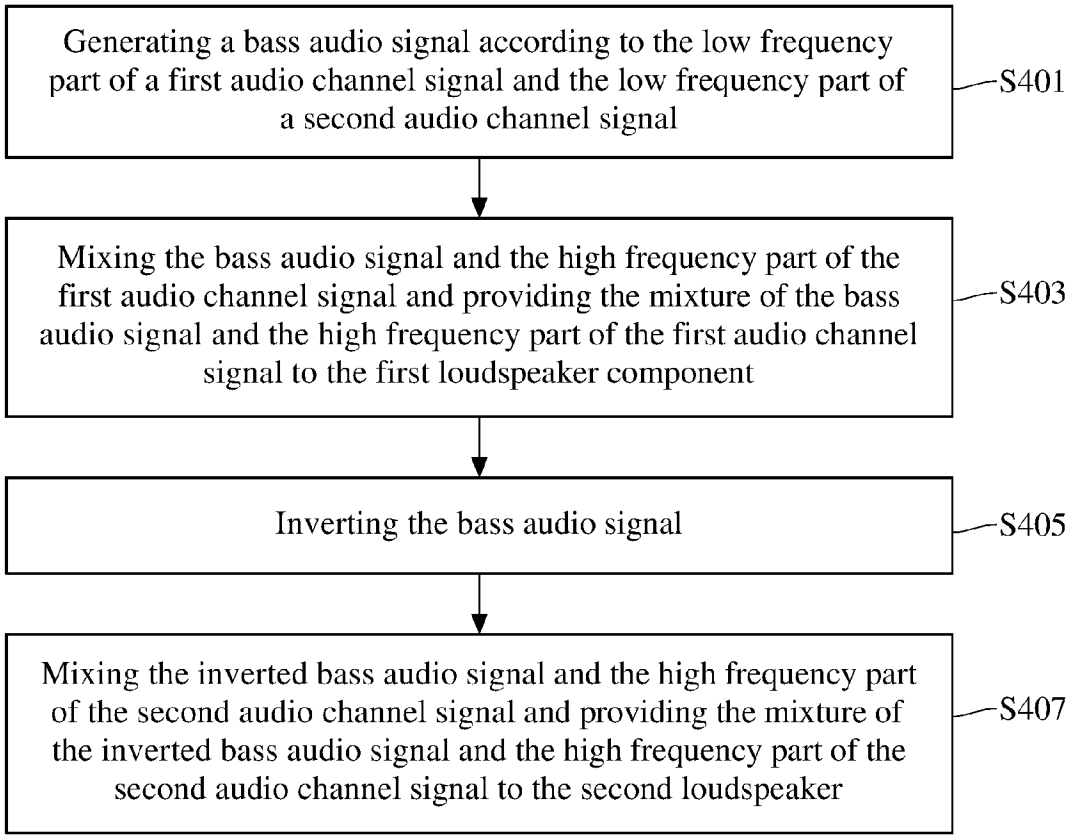
FIG. 8 is a flow chart of a control method in an embodiment of this disclosure.

To explain the control method of the loudspeaker device more clearly, please refer to FIG. 1 to FIG. 3 and FIG. 8. FIG. 8 is a flow chart of a control method in an embodiment of this disclosure. As shown in the figures, in the step S401, the bass audio signal is generated according to the low frequency part of the FACS and the low frequency part of the SACS; in the step S403, the bass audio signal is mixed with the high frequency part of the FACS, and a mixture of the bass audio signal and the high frequency part of the FACS is provided to the FLC; in the step S405, the bass audio signal is inverted; in the step S407, the inverted bass audio signal is mixed with the high frequency part of the SACS, and a mixture of the inverted bass audio signal and the high frequency part of the SACS is provided to the second loudspeaker. In this way, when the FLC 13 and the SLC 15 output sound effects, the first vibration diaphragm 131 and the second vibration diaphragm 151 thrust in opposite directions relative to the inner space of the loudspeaker box 11. While the inner space occupies a smaller capacity, it turns out that noise and harmonic distortion, which would be caused by a change of air pressure inside the loudspeaker box 11 if the first vibration diaphragm 131 and the second vibration diaphragm 151 simultaneously thrust inwardly or outwardly, could be avoided by having the first vibration diaphragm 131 and the second vibration diaphragm 151 respectively thrust in opposite directions. Actually, the control method of the loudspeaker device in this disclosure has been described in the aforementioned embodiments, we shall not repeat describing the control method here.

This disclosure also provides an audio processing circuit for converting signals of a number of original audio channels into signals of a number of terminal audio channels. For example, the original audio channels are the receiving ends CH1~CH3 in the aforementioned embodiment, and the terminal audio channels are the loudspeaker components 13, 15, 23, 25, 33, 35, 37. The audio processing circuit includes a low pass filtering unit, a high pass filtering unit, an inverting unit and a mixing unit. For example, the low pass filtering unit includes the low pass filters 272, 391*a*, 391*b*, or 391*c* in the aforementioned embodiments. The low pass filtering unit extracts a low frequency part from the signals of the original audio channels. The high pass filtering unit includes the high pass filters 273, 274, 392*a*, 392*b*, or 392*c* in the aforementioned embodiments. The high pass filtering unit extracts a number of high frequency parts from the signals of the original audio channels. The inverting unit includes, for example, the aforementioned inverters 275, 394*a*, 394*b*, or 394*c*. The inverting unit inverts the low frequency part to output an inverse low frequency part. The mixing unit includes, for example, the aforementioned mixers 175*a*, 175*b*, 276*a*, 276*b*, 395*a*, 395*b*, or 395*c*. The mixing unit mixes the low frequency part with one of the high frequency parts to produce a mixture of the low frequency part and the high frequency part as one of the signals of the terminal audio channels. The mixing unit also mixes the inverse low frequency part with another one of the high frequency parts to produce a mixture of the inverse low frequency part and the high frequency part as another one of the signals of the terminal audio channels signals. Actually, the audio processing circuit of this disclosure has been described in the aforementioned embodiments, the detail description shall be skipped here.

This disclosure also provides a processing method of audio signals for converting signals of a number of original audio channels into signals of a number of terminal audio channels. The processing method includes the following steps: filtering a low frequency part out of the signals of the original audio channels, filtering a number of high frequency parts out of the signals of the original audio channels, inverting the low frequency part to output an inverse low frequency part, mixing the low frequency part with one of the high frequency parts for outputting a mixture of the low frequency part and the high frequency part as one of the signals of the terminal audio channels, and mixing the inverse low frequency part with another one of the high frequency parts for outputting a mixture of the inverse low frequency part and the high frequency part as another one of the signals of the terminal audio channels signals. Actually, the processing method of audio signals of this disclosure is described in the aforementioned embodiments; the detail description shall be skipped here.

In view of the above description, one or more embodiments of this disclosure provide a balanced push-pull loudspeaker device and a control method thereof, an audio processing circuit, and a processing method of audio signals. In the disclosure, the low frequency parts of a number of audio channel signals are mixed to generate a bass audio signal, the high frequency part of each audio channel signals is mixed with either the bass audio signal or the inverted bass audio signal to generate a mixed signal, and then the mixed signals are respectively provided to the loudspeaker components. In this way, when the loudspeaker components output sound effects, the vibration diaphragms of the loudspeaker components respectively inwardly or outwardly thrust relative to the inner space of the loudspeaker box so that the capacity of the inner space of the loudspeaker box is approximately balanced. Therefore, the possibility that noise and the harmonic distortion, which would be caused by a great change off air pressure inside the loudspeaker box 11 if all the vibration diaphragms simultaneously thrust in the same direction, is reduced. Moreover, according to one or more embodiments of this disclosure, each of the audio channel signals is filtered into the low frequency part and the high frequency part, so when the bass audio signal is mixed with the high frequency part of the original audio channel signal, the distortion after mixing may also be reduced and the sounds reproduced by the loudspeaker device may have a high quality.

What is claimed is:

1. A balanced push-pull loudspeaker device, comprising:

a loudspeaker box comprising a first opening and a second opening, wherein the first opening and the second opening are on a casing of the loudspeaker box;

a first loudspeaker component comprising a first vibration diaphragm, wherein the first vibration diaphragm covers the first opening of the loudspeaker box and sinks into an inner space of the loudspeaker box relative to the first opening;

a second loudspeaker component comprising a second vibration diaphragm, wherein the second vibration diaphragm covers the second opening of the loudspeaker box and sinks into the inner space of the loudspeaker box relative to the second opening; and an audio processing module configured to generate a bass audio signal according to a low frequency part of a first audio channel signal and a low frequency part of a second audio channel signal, mix the bass audio signal and a high frequency part of the first audio channel signal, output a mixture of the bass audio signal and the high frequency part of the first audio channel signal to the first loudspeaker component, invert the bass audio signal, mix the inverted bass audio signal and a high frequency part of the second audio channel signal, and output a mixture of the inverted bass audio signal and the high frequency part of the second audio channel signal to the second loudspeaker component, and the first vibration diaphragm and the second vibration diaphragm respectively thrusting in two opposite directions relative to the inner space of the loudspeaker box when the first loudspeaker component and the second loudspeaker component output sound effects.

2. The balanced push-pull loudspeaker device according to claim 1, wherein the audio processing module comprises:

a first audio processor configured to receive the first audio channel signal and output the high frequency part, which has a frequency higher than a first cutoff frequency, of the first audio channel signal and the low frequency part, which has a frequency lower than the first cutoff frequency, of the first audio channel signal;

a second audio processor configured to receive the second audio channel signal and output the high frequency part, which has a frequency higher than a second cutoff frequency, of the second audio channel signal and the low frequency part, which has a frequency lower than the second cutoff frequency, of the second audio channel signal; and a bass mixer configured to mix the low frequency part of the first audio channel signal and the low frequency part of the second audio channel signal to generate the bass audio signal.

3. The balanced push-pull loudspeaker device according to claim 1, wherein the audio processing module comprises an audio mixer, a low pass filter, a first high pass filter and a second high pass filter, the audio mixer is configured to mix the first audio channel signal and the second audio channel signal and output a mixture of the first audio channel signal and the second audio channel signal to the low pass filter for low pass filtering, the low pass filter is configured to output the bass audio signal, the first high pass filter is configured to process the first audio channel signal by high pass filtering and output the high frequency part of the first audio channel signal, and the second high pass filter is configured to process the second audio channel signal by high pass filtering and output the high frequency part of the second audio channel signal.

4. The balanced push-pull loudspeaker device according to claim 1, further comprising a third loudspeaker component, wherein the audio processing module is configured to generate the bass audio signal further according to a low frequency part of a third audio channel signal, and the audio processing module further comprising a plurality of output mixers and a plurality of inverters, the plurality of inverters is respectively coupled to the plurality of output mixers, and the plurality of output mixers is respectively coupled to the first loudspeaker component, the second loudspeaker component and the third loudspeaker component, the output mixer, which is coupled to the third loudspeaker component, is configured to receive the bass audio signal according to control information selectively from the coupled inverter, mix the bass audio signal and the high frequency part of the third audio channel signal, and output a mixture of the bass audio signal and the high frequency part of the third audio channel signal to the third loudspeaker component.

5. A control method of a balanced push-pull loudspeaker device, comprising a loudspeaker box, a first loudspeaker component and a second loudspeaker component, wherein the first loudspeaker component comprises a first vibration diaphragm, the second loudspeaker component comprises a second vibration diaphragm, and the control method comprises steps of:

generating a bass audio signal according to a low frequency part of a first audio channel signal and a low frequency part of a second audio channel signal;

mixing the bass audio signal and a high frequency part of the first audio channel signal and providing a mixture of the bass audio signal and the high frequency part of the first audio channel signal to the first loudspeaker component;

inverting the bass audio signal; and mixing the inverted bass audio signal and a high frequency part of the second audio channel signal and providing a mixture of the inverted bass audio signal and the high frequency part of the second audio channel signal to the second loudspeaker component;

wherein the first vibration diaphragm and the second vibration diaphragm respectively thrust in two opposite directions relative to an inner space of the loudspeaker box when the first loudspeaker component and the second loudspeaker component output sound effects.

6. The control method according to claim 5, further comprising steps of:

filtering the first audio channel signal to generate the high frequency part, which has a frequency higher than a first cutoff frequency, of the first audio channel signal and the low frequency part, which has a frequency lower than the first cutoff frequency, of the first audio channel signal;

filtering the second audio channel signal to generate the high frequency part, which has frequency higher than a second cutoff frequency, of the second audio channel signal and the low frequency part, which has a frequency lower than the second cutoff frequency, of the second audio channel signal; and mixing the low frequency part of the first audio channel signal and the low frequency part of the second audio channel signal to generate the bass audio signal.

7. The control method according to claim 5, further comprising steps of:

mixing the first audio channel signal and the second audio channel signal;

processing a mixture of the first audio channel signal and the second audio channel signal by low pass filtering to generate the bass audio signal;

processing the first audio channel signal by high pass filtering to generate the high frequency part of the first audio channel signal; and processing the second audio channel signal by high pass filtering to generate the high frequency part of the second audio channel signal.

8. The control method according to claim 5, wherein the balanced push-pull loudspeaker device further comprises a third loudspeaker component, comprising a third vibration diaphragm; in the step of generating the bass audio signal according to the low frequency part of the first audio channel signal and the low frequency part of the second audio channel signal, the loudspeaker device generates the bass audio signal further according to a low frequency part of a third audio channel signal; and the control method further comprises according to control information, selectively mixing the high frequency part of the third audio channel signal with either the bass audio signal or the inverted bass audio signal, and providing a mixture of the high frequency part of the third audio channel signal and either the bass audio signal or the inverted bass audio signal to the third loudspeaker component.

9. An audio processing circuit for converting signals of a plurality of original audio channels into signals of a plurality of terminal audio channels, and the audio processing circuit comprising:

a low pass filtering unit configured to filter a low frequency part out of the signals of the plurality of original audio channels;

a high pass filtering unit configured to filter a plurality of high frequency parts out of the signals of the plurality of original audio channels;

an inverting unit configured to invert the low frequency part to output an inverse low frequency part; and a mixing unit configured to mix the low frequency part with one of the plurality of high frequency parts, output a mixture of the low frequency part and the high frequency part as one of the signals of the plurality of terminal audio channels, mix the inverse low frequency part with another one of the plurality of high frequency parts, and output a mixture of the inverse low frequency part and the high frequency part as another one of the signals of the plurality of terminal audio channels.

* * * * *